US005605237A

United States Patent [19]

Richardson et al.

[11] Patent Number: 5,605,237

[45] Date of Patent: Feb. 25, 1997

[54] PRODUCT ADVANCE MECHANISM

[75] Inventors: Richard J. Richardson, Simi Valley; Charles E. Crown, San Fernando, both of Calif.

[73] Assignee: Anthony's Manufacturing Company, Inc., San Fernanado, Calif.

[21] Appl. No.: 355,615

[22] Filed: Dec. 14, 1994

[51] Int. Cl.[6] ..... A27F 5/00

[52] U.S. Cl. ..... 211/59.3; 211/51; 312/71

[58] Field of Search ..... 211/184, 51, 59.3, 211/43; 312/71

[56] References Cited

U.S. PATENT DOCUMENTS

| | | | |
|---|---|---|---|
| 1,291,420 | 1/1919 | Cough . | |
| 1,638,181 | 9/1927 | Bell . | |
| 1,703,987 | 3/1929 | Butler . | |
| 2,110,299 | 3/1938 | Hinkle . | |
| 2,222,887 | 11/1940 | Willey . | |
| 2,652,154 | 9/1953 | Stevens . | |
| 2,806,631 | 9/1957 | Van Vactor . | |
| 3,028,014 | 4/1962 | Southwick . | |
| 3,083,067 | 3/1963 | Vos et al. | 211/59.3 X |
| 3,357,597 | 12/1967 | Groff . | |
| 3,379,313 | 4/1968 | Reddig et al. | 312/71 X |
| 3,433,546 | 3/1969 | Cohen | 211/59.3 X |
| 3,452,983 | 7/1969 | Cook et al. | 211/51 X |
| 3,542,208 | 11/1970 | Miner . | |
| 3,570,680 | 3/1971 | Klassen et al. . | |
| 4,042,096 | 8/1977 | Smith . | |
| 4,106,668 | 8/1978 | Gebhardt . | |
| 4,351,439 | 9/1982 | Taylor . | |
| 4,729,481 | 3/1988 | Hawkinson et al. . | |
| 4,836,390 | 6/1989 | Polvere | 211/59.3 |
| 4,898,282 | 2/1990 | Hawkinson et al. . | |
| 4,907,707 | 3/1990 | Crum . | |
| 5,240,126 | 8/1993 | Foster et al. | 211/59.3 |
| 5,265,738 | 11/1993 | Yablans et al. | 211/59.3 |

*Primary Examiner*—Robert W. Gibson, Jr.
*Attorney, Agent, or Firm*—Poms, Smith, Lande & Rose Professional Corporation

[57] ABSTRACT

A product advance mechanism is described and includes a product contact element for contacting a product and for moving so as to push the product. A track is included for supporting and guiding the product contact element as the contact element moves. A bias element biases the product contact element in a direction along the track, and a brake mechanism controls the amount of bias applied to the product element.

19 Claims, 8 Drawing Sheets

FIG. 4
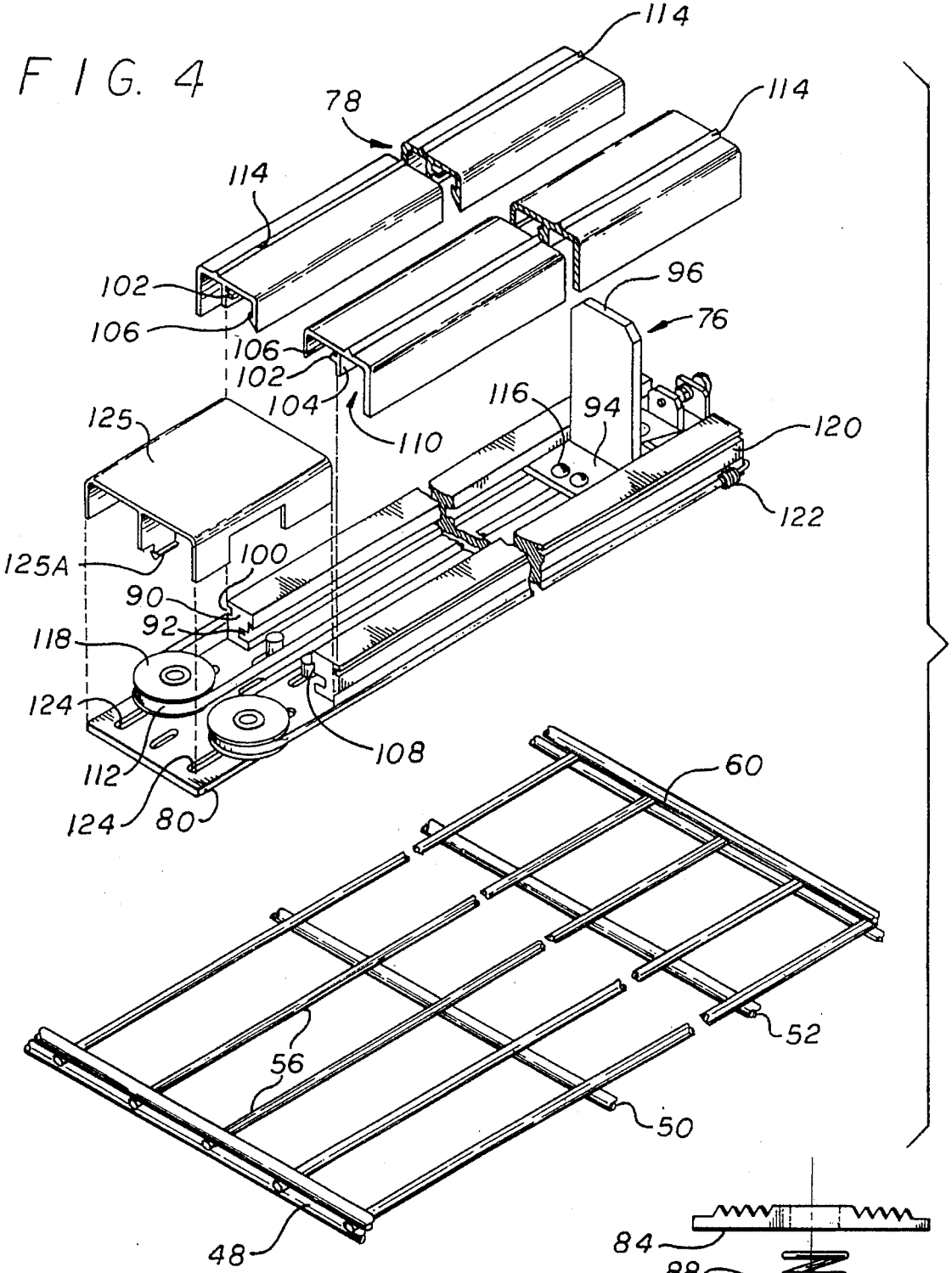
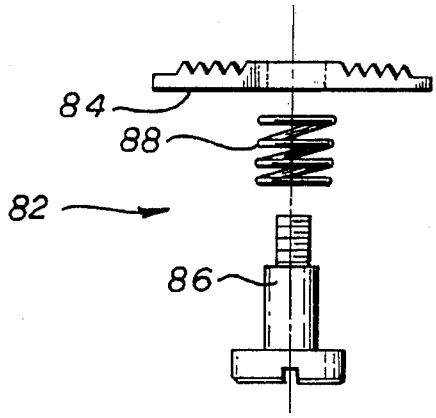
FIG. 6

PRODUCT ADVANCE MECHANISM

BACKGROUND OF THE INVENTION

1. Field of the Invention

The present invention relates to product advance mechanisms such as shelf units having mechanisms for pushing products to the front of the shelf, such as for grocery store display cases, and the like.

2. Related Art

Product presentation is of utmost importance in marketing product, such as in grocery stores, hardware stores and the like, where the customer views and compares product, and chooses a particular product from a display. Product viewability, product access for the customer and product freshness, in situations of sale of perishable products, is a primary concern. Where products are perishable, product is preferably rotated so that the items on the shelves the longest are removed first, before more recently added product of the same type are selected by the customer.

Product resupply is also important to merchandisers. Shelves should be easily accessible for placing new product on a shelf. Adequate shelf space is also important to ensure proper product volume so that supply is not exhausted too quickly. Merchandisers can ensure that there is sufficient product on a shelf by including enough shelf space to be stocked to minimize the possibility of running out of product.

Several arrangements have been used to ensure that product is constantly positioned at the front of a shelf for presentation to a customer. In recent years, convenience stores have used slanted shelves for such products as canned beverages, packaged food stuffs and other product in such a manner as to permit product to advance to the front of the shelf simply by gravity so that product is always positioned at the front of the shelf. Such gravity feed shelves require more shelf space for a given amount of product relative to horizontally positioned product. However, slanted shelves provide the benefit of always having product at the front of the shelf, without requiring personnel to push stock forward toward the front of the shelf.

In addition to taking up more space relative to a comparable horizontal shelf, slanted shelves typically are suitable only for eye level locations. Eye level locations for product presented on a slanted shelf system can be easily viewed, and typically have sufficient light to allow a customer to read information on a product. However, product positioned on upper shelves may not be as easily accessible, and product on gravity feed systems below eye level are naturally slanted downward and are more difficult to view for that reason.

Product push mechanisms have been used on horizontal shelves whereby a push bracket is positioned behind aligned product and pushes the product forward as soon as a front-most product is removed from the line. The push bracket is typically biased to push product forward. Product is retained aligned on the shelf by conventional side rails or by adjacent product, and product is prevented from moving off of the shelf by a guard which extends across the front of the shelf.

Typical product push mechanisms are designed for a given product size and shape. A product push mechanism is designed according to the weight of the product, and its moveability on the shelf. The push mechanism would have a stronger bias on the push bracket for heavier product in order to move multiple items of product aligned on the shelf compared to a lighter product. If a different product were to be displayed using the same push mechanism, changes may be necessary in order to accommodate the different product, because of a difference in size or in weight, for example. A lighter product would not require as much bias on the push bracket in order to adequately advance the product to the front of the shelf. Too much bias on the push bracket could eject the front product out of the brackets or bars which contain the product. Too little bias would not adequately advance the product to the front of the shelf. Therefore, a given product push mechanism is typically suitable only for a narrow range of product weights and sizes.

If a separate product push mechanism is made for each type of product and size, manufacturing efficiencies decrease. Additionally, multiple sizes and configurations of product push mechanisms would mean that a different push mechanism would be required if a different product were to be displayed.

There is a need, therefore, for a product push mechanism which will accommodate different sizes and weights of product without having to switch out or replace the product advance mechanism in every case to accommodate a heavier product or a different sized product.

SUMMARY OF THE INVENTION

In accordance with the present invention, a product advance mechanism is provided which is more versatile in use and can accommodate product of different sizes and weights and different packaging. The product advance mechanism includes a product element and a track for supporting and guiding the product contact element as the contact element moves. A bias element biases the product contact element, such as to advance product toward the front of a shelf. A brake or damping element, for example between the product contact element and a track in which the product contact element is supported and guided, controls the amount of bias applied to the product contact element, for example to provide a bias appropriate for the given product weight and size. Preferably, the brake or damping element is adjustable to provide a substantially continuous or linear degree of control over the amount of bias provided to the contact element. For example, the bias element may be designed for pushing a large or heavy product, but may also be intended for use with a light product, without changing the bias element. The brake or damping element would reduce the amount of force applied to the product when the product is lighter or smaller, or if for some other reason the counterforces opposing the bias change.

In the preferred embodiment, the brake or damping element may be formed from a converging cam element in sliding contact with one or more brake pads which contact the track in a preferably frictional engagement. Positioning of the brake pads relative to the converging cam surface or positioning of the cam surface relative to the brake pads determines the frictional engagement between the brake pads and the track. For a lighter or smaller product, the engagement between the brake pads and the track is greater so that the force applied to the product is less than the maximum force available, with a given bias element.

A limiting factor for the depth or front-to-back dimension of a conventional shelf is how far back a customer can reach to remove product. However, with the product advance mechanism of the present invention, shelves can be made any longitudinal length, regardless of customer reach, since product is automatically advanced when a product is removed from the front of the shelf. Such a product advance mechanism also improves product presentation on upper and lower shelves since the customer can easily access such product when the product is automatically moved to the front of the shelf. Without the product advance mechanism, product on flat or slanted shelves are more difficult to access for upper and lower shelves because of the difficulty of reaching to the back of the shelf.

The present invention allows shelves with a greater depth or front-to-back dimension, providing more product stocking capability and a reduction in restocking frequency. Additionally, extra shelving can be installed in the space saved by substitution of the present system for the conventional gravity feed shelving. Shelving that displays product over the entire front edge of the shelf offers a very attractive product display and allows the product to be well illuminated. In situations where a display uses rear load shelving, product rotation occurs automatically with restocking from the back. Product is sold first-in-first-out.

The product advance mechanism provides for a smooth operation, saves space relative to gravity feed apparatus, is adjustable and facilitates product rotation. The arrangement ensures customer comfort and viewability of the product and uniform lighting of all product presented at the front of the shelf. Deeper shelves reduce product restocking frequency and allow stocking of more product. The product advance mechanism is easily mountable onto a shelf system, regardless of the direction of the shelf rails or rods.

In a preferred form of the invention, the track is a stainless steel track and the brake or damping element riding on or in the track is preferably a low friction plastic.

It is therefore an object of the present invention to provide a product advance mechanism that is more versatile in use and application, and can accommodate a greater variety of products in size and weight.

It is a further object of the present invention to provide a product advance mechanism which is easy to manufacture, assemble, install and control for any in a given range of product sizes and shapes.

It is also an object of the present invention to provide a shelf assembly which more efficiently presents product, provides a more uniform product display than gravity feed product displays, and which improves product rotation.

These and other aspects of the present invention will become more apparent after a review of the drawings, a brief description of which immediately follows, along with consideration of the detailed description of the preferred embodiments.

BRIEF DESCRIPTION OF THE DRAWINGS

FIG. 4 is a perspective view of a product advance mechanism mounted on a shelf for a display case.

FIG. 6 is an exploded elevation view of a mechanism for holding the mechanism on the shelf.

DETAILED DESCRIPTION OF THE PREFERRED EMBODIMENTS

In accordance with the present invention, a product display case and product advance mechanism for use therewith are described and provide an apparatus and method for efficiently producing and using a product advance mechanism. The product advance mechanism of the present invention can be formed as an integral part of a shelving system or may be separately mounted onto a shelving system, such as one with the original display case or as a retrofit. The product advance mechanism is easily usable with a wide variety of product sizes and shapes, is easily adjustable to accommodate different conditions, such as different product weights and shapes. It conserves shelf space, improves product rotation and product presentation.

Figure 1:
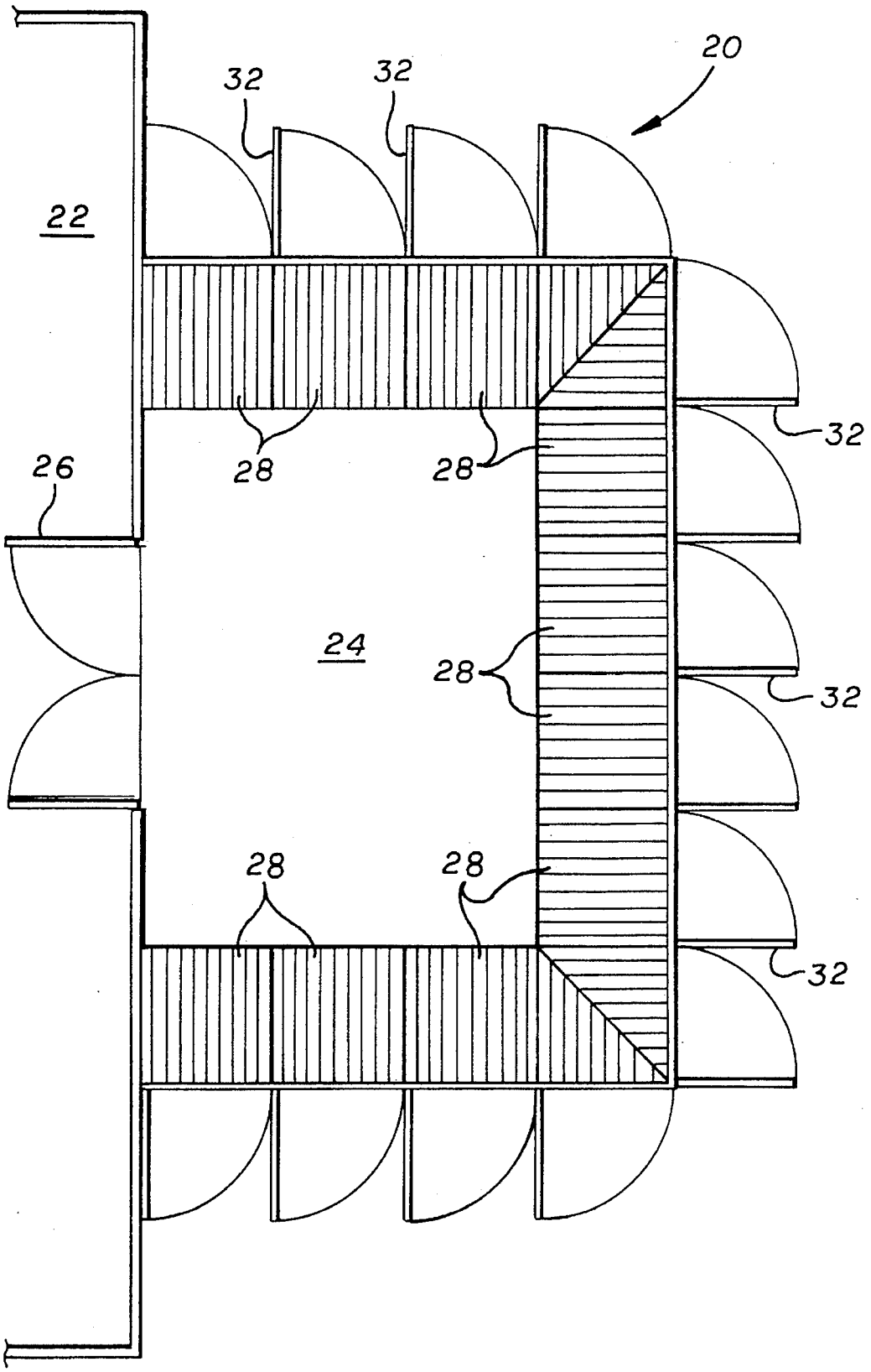
FIG. 1 is a schematic and plan view of a walk-in cooler arrangement with which the present invention may be used.

In one preferred form of the invention, the product advance mechanism may be used with a shelving arrangement for a walk-in box 20 (FIG. 1) so designed as to enable stocking of considerable quantities of product on the shelves. Use of the product advance mechanism according to the present invention, described more fully below, allows deeper shelves for more product volume while still presenting product at the fronts of the shelves for selection. More product on the shelves reduces storage space required in other areas of the store, such as back room storage, and reduces the need for product shifting from the storage area to the shelf. It also reduces labor costs required for more frequent restocking and product shifting necessary with shorter shelves. The walk-in box 20 includes a stock room 22 immediately adjacent the walk-in box and a stock area 24 within the perimeter of the walk-in box separated by stock room doors 26. The box 20 also includes shelving 26 in conjunction with which the product advance mechanism is used.

Figure 2:
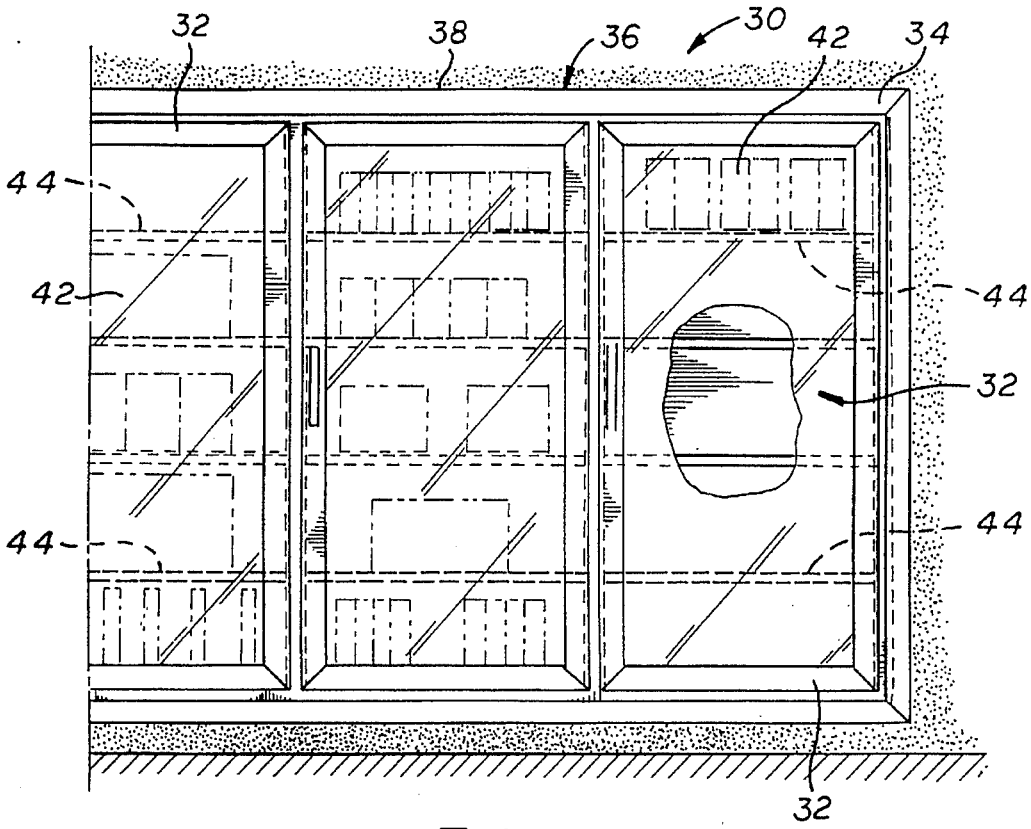
FIG. 2 is a perspective view of a refrigerated display case for use in accordance with one aspect of the present invention.

From the point of view of the customer, the customer will see a product display case 30 with doors 32 mounted for swinging movement in a surrounding frame 34 (FIG. 2). While the display case 30 has been shown as a walk-in unit, it should also be understood that it also may be a free-standing unit or a movable unit, among others. The case may include a frame 36 formed in a wall 38 of the cooler, or may take other configurations. The display case may also be an open case, or simply include free-standing shelving often used for presenting product. The product advance mechanism of the present invention may also be used for presenting products other than refrigerated products, such as dry goods and other merchandise. The display case may also be accessible from any side.

Figure 3:
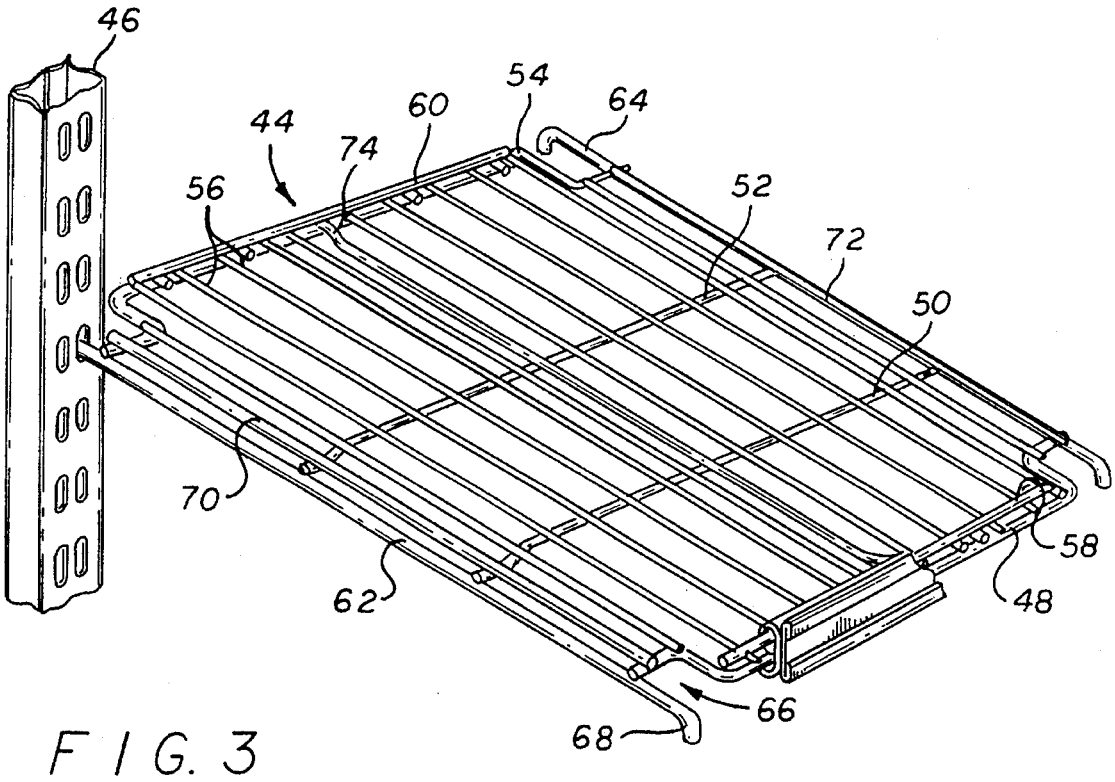
FIG. 3 is a perspective view of a wire shelf for use with the present invention, and to which a product moving apparatus may be mounted or integrally formed.

The doors 32 have glass panels 40 to allow a customer and others, in a supermarket, for example, to look through the panels at items or product 42 displayed or presented on shelves 44 inside the case. Typical refrigeration units use shelves 44 (FIG. 3) that are assembled in units, with the shelves supported by a shelf post 46 through shelf brackets engaging the shelf post 46. The shelf would be supported by the shelf post at each of the four corners, in the conventional construction. The shelf post assembly may be either stationary or moveable.

Each shelf assembly may have one or more shelves 44 to make up the shelf assembly. Each shelf typically includes a front lateral support rod 48, a first intermediate lateral support rod 50, a second intermediate lateral support rod 52 and a back lateral support rod 54 extending from one side of the shelf to the other side of the shelf for supporting a plurality of longitudinal shelf rods 56 on which the products sit. The front and rear lateral support rods 48 and 54 typically define the forward-most and rearward-most extent of the shelf. The front ends of the shelf rod 56 are typically spot welded to the top of the front lateral support rod 48, and the opposite ends are spot welded to the rear lateral support rod 54. A front curb rod 58 is placed across the top of and welded to the longitudinal shelf rod 56 at the front of the shelf and a rear curb rod 60 is similarly welded to the back portions of the shelf rods. The shelf rods are also welded to the second and third intermediate lateral support rods 50 and 52 for stability.

At the lateral extent of the front and back lateral support rods 48 and 54, the support rods form a Z-shape in the plane of the shelf and are attached to the left longitudinal support rod 62 and to the right longitudinal support rod 64. The Z-shape and the ends of the longitudinal support rods 62 and 64 define an opening 66 for accommodating the shelf post structure. The left longitudinal support rod and the right longitudinal support rod engage openings in the shelf support through conventional hooks 68 at the front and rear corners of the shelves. The lateral support rods 48–54 are spot welded to each of the longitudinal support rods 62 and 64 for structural support. A left curb rod 70 and a right curb rod 72 rest on the top ends of the lateral support rods and are welded thereto. An intermediate longitudinal support rod 74 is welded to and extends from between the front lateral support rod 48 and the front curb rod 58 backward underneath the second and third support rods 50 and 52 to be welded to the back lateral support rod 54 and the rear curb rod 60.

In order to automatically move items or products to the front of the shelf or to the front of a rack, it has been common to tilt the shelf so that the product is gravity fed to the front of the shelf. Because a gravity feed shelf is positioned at a slant in the case or structure, the gravity feed system requires more volume per shelf than a horizontal shelf system. Additionally, the angle of the shelf from the horizontal necessarily varies with the type and size of the product, the type of packaging and the weight of the product. Therefore, gravity feed shelving systems often must be designed differently for each type of product being presented.

The present invention provides a product advance mechanism which keeps product at the front of the shelf, but without taking up the additional space required by gravity feed systems. The present product advance mechanism operates on horizontal or slanted shelves, and does not rely on gravity for advancing the product. The product advance mechanism can be integrated in a shelf system or may be added as a separate unit or retrofit onto existing shelf systems. In a preferred embodiment of the invention (FIG. 4), the product advance mechanism is removably mounted on the wire shelf, such as was described with respect to FIG. 3, for maintaining product in position at the front of the shelf. The preferred embodiment is easily adjustable to handle a variety of product sizes and weight, and can be optimized for each product size and weight without substituting parts, within a reasonable range of product. The product advance mechanism also can be easily removed for cleaning and servicing.

In one preferred embodiment of a removable product advance mechanism for a shelf (FIG. 4), the product advance mechanism 75 includes a product contact element in the form of a push bracket 76 for contacting a product and providing a bias to push the product as a front item of product is removed and the push bracket 76 moves towards the front of the shelf. Product is supported by product glide 78, both of which are supported along with the push bracket on a base element or a base plate 80.

Considering the product advance mechanism in more detail (FIG. 4–11), the base plate 80 may be formed from a single unitary material or from segments. The product advance mechanism may extend any desired length but typically would extend the entire longitudinal length of the shelf to maximize the amount of shelf space used. The base plate 80 is mounted to one or more and preferably at least two shelf rods 56 to reliably fix the product advance mechanism in place.

Preferably, a multiple ridged clamp bracket 84 (FIG. 6) is rotatably mounted on the underside of the base plate 80 adjacent each end of the product advance mechanism in order to hold the mechanism stationary on the shelf. A heavy fastener is not required for typical advance mechanisms since the weight of the product will tend to hold the mechanism in place on the shelf. The multiple grooves on the clamp bracket 84 engage the undersides of two adjacent longitudinal shelf rods 56 (see FIGS. 9–11) and accommodate wire shelves having different rod spacings (see FIGS.

9–11). The clamp bracket 84 may also mount the mechanism to one of the more substantial rods on the shelf.

The clamp 82 is preferably fastened to the bottom of the base plate 80 by a threaded or other bolt 86 fastened to the bottom of the base plate and having an enlarged head for capturing a coil spring 88 for biasing the clamp bracket 84 against the shelf rods. The clamp bracket 84 is rotatable about the shaft of the bolt 86 so that the advance mechanism can be lifted from the shelf. To do so, the clamp bracket 84 is pulled against the bias of the spring, to separate the clamp bracket from the shelf rod 56. The clamp bracket is then rotated 90 degrees so that the bracket can slip between the adjacent shelf rod, the width of the longitudinal portion of the clamp bracket being less than the spacing between the shelf rods 56.

A slide rail 90 (FIG. 4), and preferably a pair of oppositely disposed slide rails 90 (FIG. 4) are fixed to or formed integral with the base plate 80 to provide a track for supporting and guiding the push bracket 76, as the push bracket moves toward the front of the shelf. The slide rail 90 may be formed integrally with the base plate 80, such as through roll forming of half hard stainless steel. The slide rails are preferably formed or configured to have oppositely facing grooves 92 for accommodating edges of the horizontal bottom flange 94 of the push bracket 76. The dimensions of the groove in terms of depth into the slide rail, in terms of the height of each groove, as well as the thickness of the bottom flange 94 are determined so as to permit free movement of the push bracket along the grooves. The grooves 92 extend longitudinally, preferably the entire length of the slide rails 90. The bottom flange 94 is preferably positioned relative to the product contact plate 96 on the push bracket so as to clear or be spaced apart from the base 80 (FIGS. 4 and 10).

Each slide rail 90 includes mounting or attachment means for securing the product glides 78 to their respective portions of the slide rails 90. The outer portion of each slide rail includes an outwardly facing groove 100 for accepting an internal flange 102 on the product glide 78. The flange is formed on a depending wall 104 extending downwardly from the interior bottom surface of the glide 78, and holds the glide at the outer surface of the slide rail 90. The glide 78 is also retained on the respective slide rail by a hook portion 106 which extends from an inner wall on the glide inwardly and upwardly toward the flange 102. The hook portion 106 engages a downwardly facing groove 108 extending longitudinally along the inside wall of the slide rail 90. Therefore, the inner portion of each glide 78 is mounted to and supported by the respective slide rail 90 through the flange 102 and the hook portion 106.

The outer portion of each product glide 78 extends outwardly beyond the laterally outer-most portion of the slide rail 90 so as to form a downwardly facing channel 110 for accommodating a hollow or solid elastic biasing element in the form of a cord 112, where a portion of the cord is positioned so as to pass along the outside of the slide rail 90. The outer portion of the product glide 78 provides a wide base surface for supporting product on the glide. Each glide 78 is mounted on its respective slide rail 90 by inserting the flange 102 into its corresponding groove 100 and then clipping the hook portion 106 into the groove 108.

Figure 10:
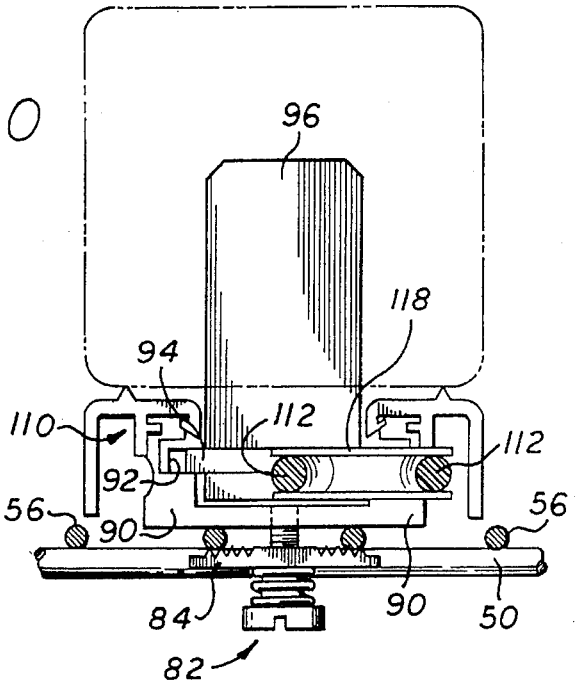
FIG. 10 is a front elevation view of the product advance mechanism of FIG. 4.
Figure 11:
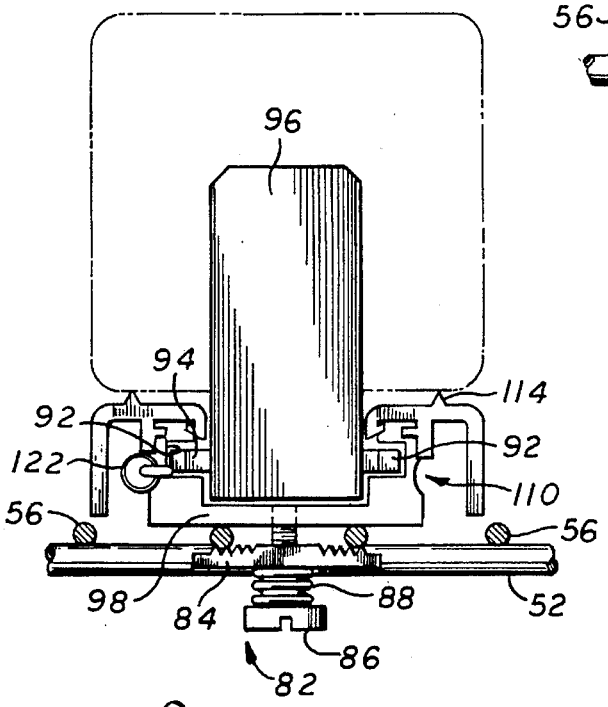
FIG. 11 is a rear elevation view of the product mechanism of FIG. 4.
Figure 9:
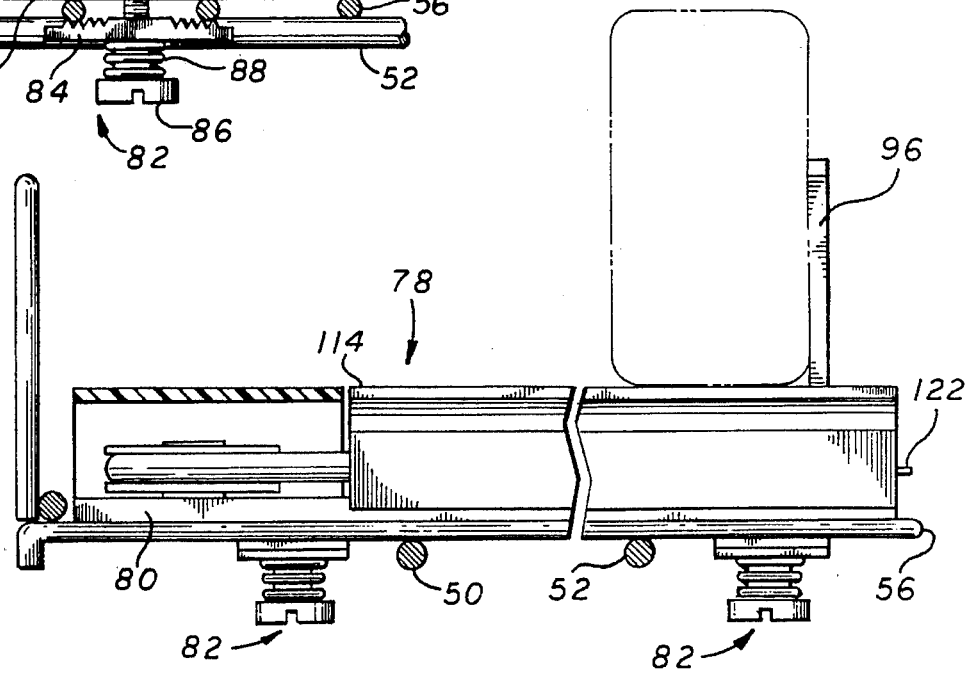
FIG. 9 is a right side elevation view of the product advance mechanism of FIG. 4.

Each product glide preferably includes a longitudinally extending glide line 114 formed in or mounted on the glide 78 and having a preferably triangular cross-section with the point being contacted by the product, as shown in FIGS. 9 and 10. Such a construction for the contact between the glide and the product minimizes friction and binding, thereby reducing the amount of push force required to move the product along the glide.

The slide rail is shown in FIG. 4 as being formed from an extrusion, such as an aluminum extrusion. The slide rail may also be formed by roll forming from a suitable material, such as half hard stainless steel (see FIG. 17). By a roll forming process, the product glides and the slide rails are formed integrally, so that no separate mounting means are used to mount separate glides onto their respective slide rails. Moreover, each of the elements of the product advance mechanism may be formed from two or more separate parts and later joined to accomplish their functions, which are provided in the preferred embodiment by an integral structure.

The base plate 80 is preferably formed with a plurality of holes or grooves passing through the bottom of the base plate to permit passage of fluids or particles such as food materials which may fall into the product advance mechanism. Such holes facilitate cleaning and reduce the possibility of contamination of the grooves 92 by accumulation of material.

A bias element in the form of one or more preferably hollow latex tubes or cords 112 bias the push bracket in a direction along the slide rail 90 so as to push product toward the front of the shelf as front product is removed. In the embodiment shown in FIG. 4, a pair of cords 112 are shown. Each cord is attached through eyelets to the bottom of the bottom flange 94 of the push bracket 76 through screws, bolts, or other fasteners 116. Each cord is then passed forward toward the front of the base plate 80 and around a respective adjustable pulley 118 so that the cord can be passed rearwardly again toward the rear portion of the product advance mechanism, where each cord is preferably removably latched or hooked to the back 120 of the product advance mechanism through hooks 122. Doubling back of the cords permits greater flexibility in adjusting the tension in the cords, and provides a greater range of settings for the force applied to the push brackets. The pulleys 118 are longitudinally adjustable to change the tension in the cords 112 by moving the pulleys to different positions in grooves 124, formed in the base plate 80. The pulleys 118 are fixed in a desired position in the grooves through suitable fasteners, while still permitting the pulleys 118 to freely rotate with movement of the cords about the pulleys, upon movement of the push bracket.

Stop pins 129 are located on the base plate 80 to stop the push bracket from contacting the pulley wheels 118. Preferably, the stop pins are otherwise positioned so that the push bracket applies no more force to the product once the last product has reached the front of the shelf.

The pulleys are preferably covered and protected by a cover 125 extending longitudinally rearward from the front of the advance mechanism toward the product glides 78 a distance sufficient to cover and protect the pulley wheels from impact. The cover 125 also preferably serves as an extension of the product glides so that product does not come to rest on the pulley wheels and to facilitate movement of product over the last portion of the forward movement of the product. The cover is preferably retained on the base plate by retaining clips 125A engaging holes in the base plate.

Figure 5:
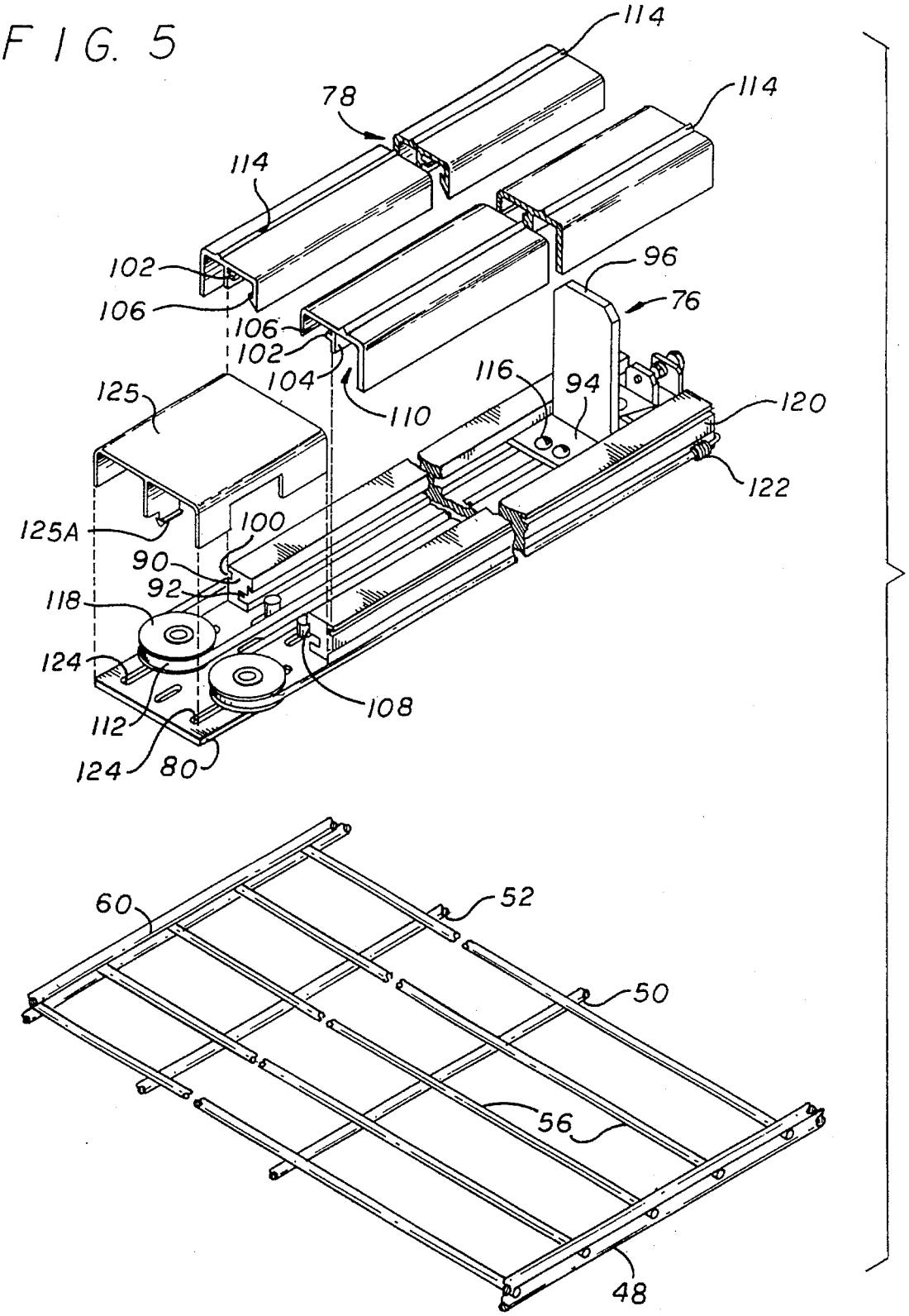
FIG. 5 is a view similar to that of FIG. 4 showing an alternate shelf configuration with which the mechanism can be used.
Figure 8:
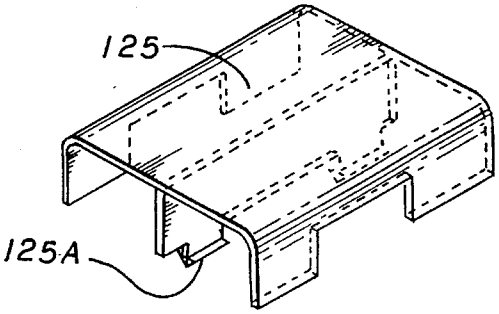
FIG. 8 is a perspective view of a product glide for covering the front portion of the product advance mechanism.
Figure 7:
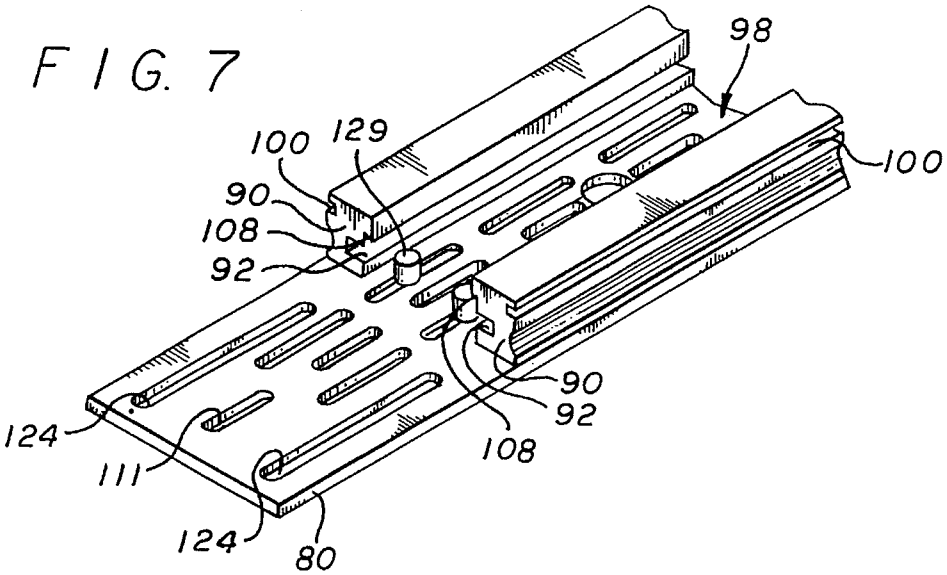
FIG. 7 is a perspective and partial cutaway view of a product slide and base plate for use with the present invention.

The product advance mechanism is shown in FIG. 4 as being aligned with the shelf rods 56. Where the shelf is made or oriented differently, such as where the shelf rods extend transversely of the shelf, for example, the advance mechanism can also be mounted so that the advance mechanism is perpendicular to the shelf rods 56 (FIG. 5). The shelf rods can extend laterally and still easily accept the product advance mechanism of the present invention. FIG. 5 shows the shelf rods extending transversely, and the product clamps can still retain the mechanism on the shelf simply by rotating the clamp plates 90 degrees and releasing them to engage the shelf rods. The product advance mechanism can be accomodated on any number of shelf configurations with appropriate mounting hardware.

In the preferred embodiment, the push bracket 76 is preferably formed from a plastic such as nylon, preferably impregnated with teflon to reduce frictional engagement between the half hard stainless steel of the slide rail and the push bracket. Other materials may be used, but it has been found that an aluminum push bracket is not as desirable since aluminum particles become embedded in the corresponding surface contacted by the push bracket.

The cord can be hollow or solid, having any diameter and can vary in length depending on the weight and shape of the product to be moved, and the distance the product has to be moved. The cord can be made from many types of material, but is preferably made from a hollow latex tubing. Various other embodiments of the invention can be easily considered by modifying the biasing arrangement for the push bracket. In one arrangement, a single cord 126 (FIG. 12A) may be used to advance light or small product along the shelf. The elastic element is relatively short, and may be used with short shelves. The cord passes around a single pulley 128 and is hooked at the rear of the advance mechanism.

For greater flexibility in setting the tension, and for application of greater force to the product, a multiple turned cord advance mechanism 130 (FIG. 12B) may be used whereby, rather than attaching the end of the cord to the rear of the advance mechanism, the cord is passed around one or more idler pulleys 132 and passed forward again to be hooked at the front of the advance mechanism. This configuration may be used for longer shelves and light to moderately heavy product. The greater length of stretch of the cord may be used to increase the force applied to the product.

Figures 12A, 12B, 12C, 12D:
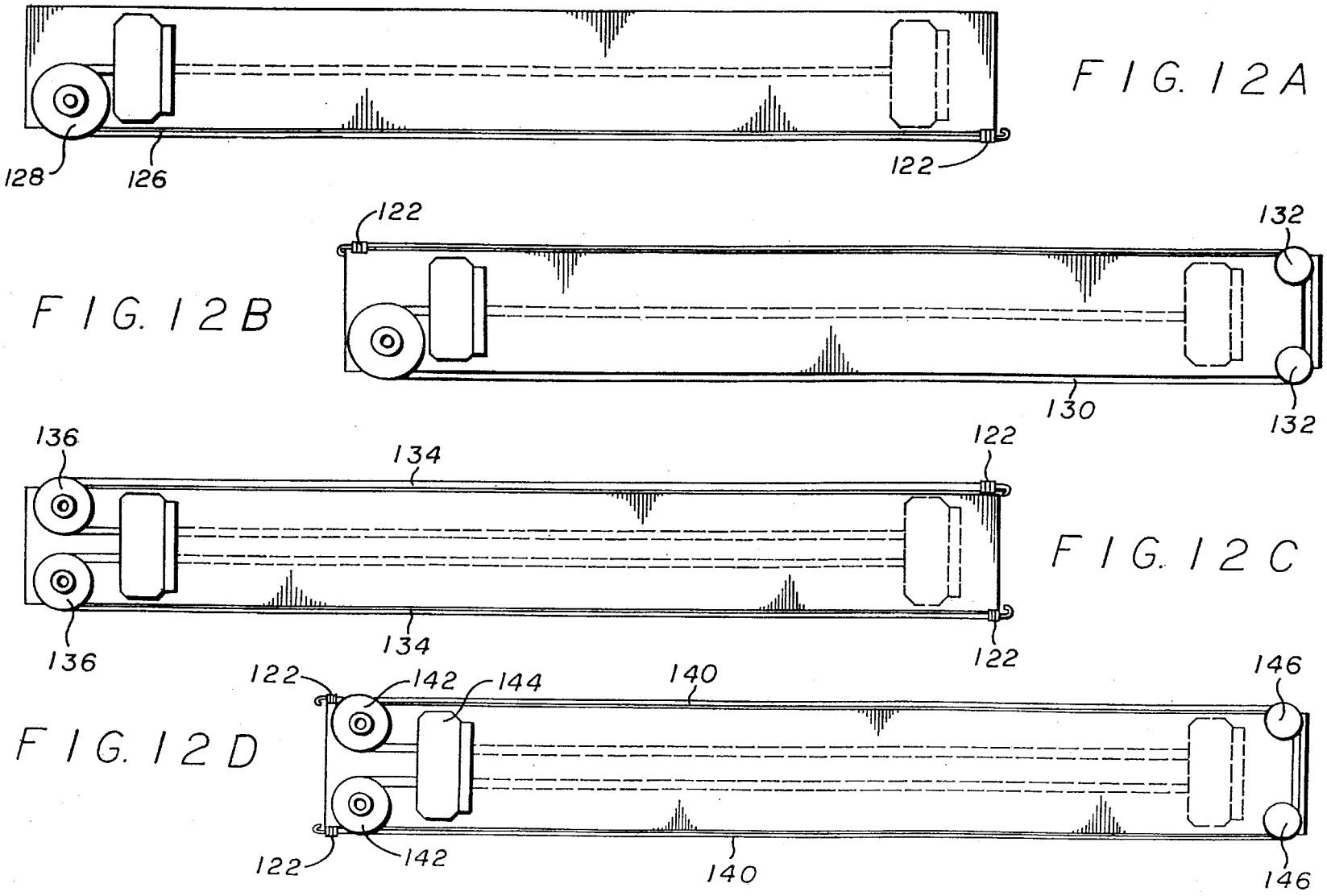
FIG. 12A is an embodiment of a product advance mechanism according to one embodiment of the present invention using an elastic element passed once around a pulley.
FIG. 12B is a plan view of a further embodiment of the present invention having an elastic element passed around multiple pulleys.
FIG. 12C is a plan view of a further embodiment of the product advance mechanism having two elastic elements passing around respective pulleys.
FIG. 12D is a further embodiment of the product advance mechanism of the present invention using plural elastic elements passed around plural pulleys.
Figure 13:
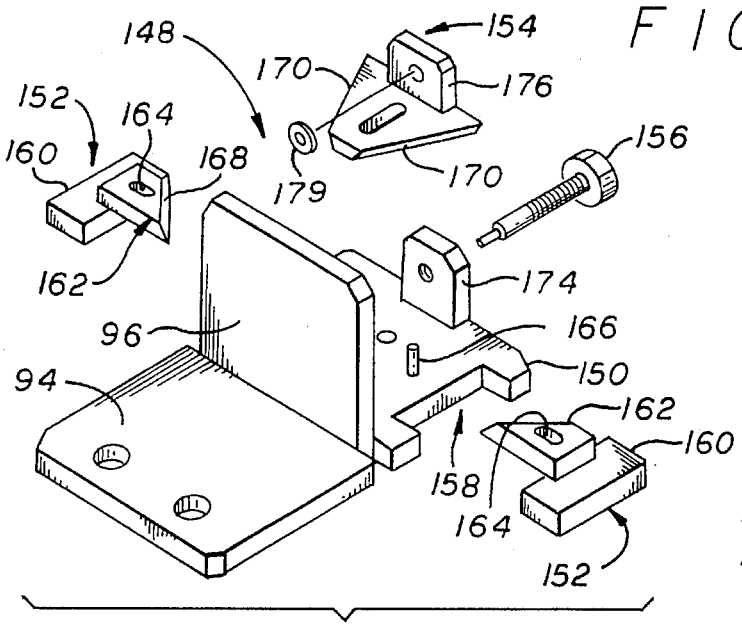
FIG. 13 is an exploded view of a push bracket for a product advance mechanism in accordance with the present invention, including a brake assembly, shown in exploded view for controlling the force supplied to a product by the push bracket.
Figure 15:
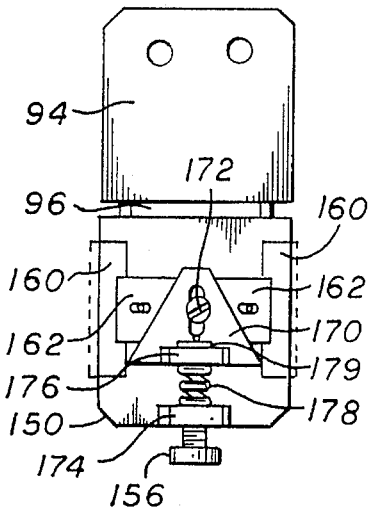
FIG. 15 is a top plan view of the push bracket and brake assembly of FIG. 13.
Figure 14:
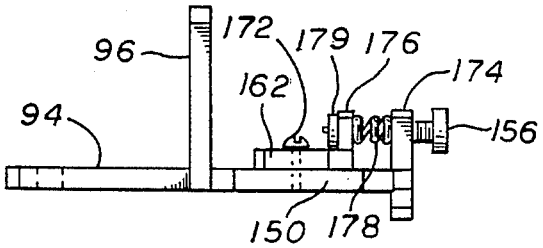
FIG. 14 is a right side elevation view of the push bracket and brake assembly of FIG. 13.
Figure 16A:
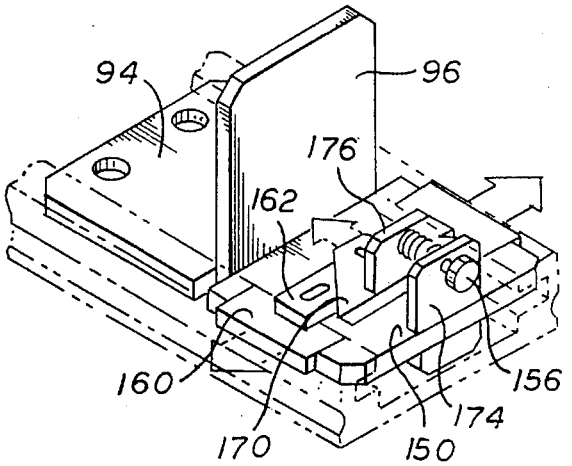
FIG. 16A is a perspective view of the push bracket and brake assembly of FIG. 13.
Figure 16:
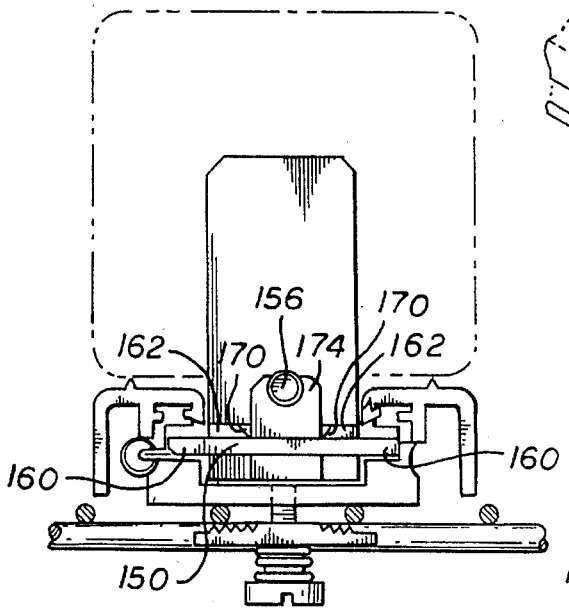
FIG. 16 is a rear elevation view of the product advance mechanism of FIG. 4.

A double pulley system 134, similar to that shown in FIG. 4, is shown in FIG. 12C. Each cord 134 is passed around a respective pulley 136 and hooked to the back of the product advance mechanism. The double pulley system may use short elastic elements for short shelves and heavier product than what might be used with the configurations shown in FIGS. 12A and 12B.

A dual cord, dual pulley system 138 (FIG. 12D) is used for longer shelves and heavier product. A pair of cords 140 pass around the respective pulleys 142 from the push bracket 144 and extend rearward to idler pulleys 146, oriented in stacked pairs, and each cord is then passed forward again to be hooked at the forward portion of the advance mechanism.

Because products have different weights, and their packaging will have different shapes, the force used to advance the product on the shelf using a horizontal product advance mechanism such as that described herein will vary from product to product. Optimally, the product advance mechanism pushes the product with a force great enough to push the product forward, given the weight and size of the product and the number of contact lengths between the product and the product glide 78. Additionally, the force should be sufficiently small to minimize the possibility that the product will be ejected from the front of the shelf after the immediately preceding product has been removed and the next product is advancing to the front of the shelf through action of the push bracket. One option is to have a different cord with its own spring constant for each product size and weight. However, having a multitude of cords would increase cost, require greater storage capacity, and may encourage people to use oversized cords for a given product to avoid having to determine which cord is optimal for the given product.

The preferred alternative is to use a product advance mechanism having known characteristics, and also providing means by which the force applied by the push bracket can be varied. For example, as discussed above, the amount of stretch or extension of the cords can be adjusted by moving the pulleys 118 (FIG. 4) to change the force applied to the product by the push bracket 76. Another alternative, for a given cord or cord combination, is to change the number of turns or switchbacks provided in a given cord, to change the force applied as a result of the extension or stretch if the cord. Another alternative is to provide a brake or damping mechanism to predictably counter the advance force provided to the push bracket by the cord.

A preferred brake mechanism 148 for the present product advance mechanism (FIGS. 13–16A) is mounted to the push bracket, preferably behind the product contact plate 96. The brake mechanism 148 provides a counter-force preferably in a direction exactly opposite to the force applied as a result of attachment of the cords to the push bracket, and may be accomplished in any number of ways. In the preferred embodiment, the brake mechanism applies a force laterally to the slide rails 90, but it should be understood that the force could be applied in any number of directions directly or indirectly to any object which does not move with the push bracket. For example, the braking force is preferably applied to a stationary element, and may be applied to the bottom of the slide rails. However, application of the force to the bottom of the slide rails is not preferred in applications where particulate matter, such as food material, may fall to the bottom of the slide rail. Debris or material in the area where the braking force is applied may unpredictably change the amount of the braking force, and, therefore, change the amount of force applied to the product. If the amount of force applied to the product changes while the product is on the shelf, too many adjustments may be needed in order to ensure proper operation of the product advance mechanism.

In the preferred embodiment, the brake mechanism includes a base plate 150, a pair of oppositely disposed brake pads 152, and a brake adjuster 154, which, in the embodiment shown in FIGS. 13–16A, includes an adjustment screw 156. The brake pads 152 are preferably housed, in the horizontal plane, in slots 158 in the sides of the base plate 150. The slots 158 are preferably rectangular U-shaped so that the brake pads 152 are limited in their longitudinal movement in a direction parallel to the push bracket 76 and inwardly toward the opposite brake pad. Other walls can be included to limit the movement of the brake pad upwardly or downwardly, but such walls are not necessary with the embodiment shown in FIGS. 13–16A.

The brake pads include friction plates 160 mounted to a cam element 162. Each cam element includes an elliptical hole 164 for accepting a pin 166 (FIG. 13) for limiting the range of movement of the brake pad laterally relative to the brake mechanism. The pins 166 are mounted to the brake mechanism base plate 150.

Each cam element 162 includes an upwardly and inwardly facing cam surface 168 for engaging and responding to movement of a corresponding cam surface 170 on the brake adjuster 154. The brake adjuster 154 is preferably a trapezoidaly shaped plate slidable along the top of the base plate 150, preferably longitudinally of the base plate. In the configuration shown in FIGS. 13–16A, the brake adjuster 154 is configured and positioned on the base plate so that the forward movement of the brake adjuster 154 toward the contact plate 96 pushes the brake pads laterally outward to increase the braking force applied to the slide rails. The brake adjuster movement is limited in the longitudinal direction by a corresponding threaded bolt 172 (FIGS. 14 and 15) and in its lateral movement by the counter-forces created by the brake pads 152. The brake adjuster is held in place vertically by a head on the bolt 172, while still allowing the brake adjuster to move longitudinally. The adjustment screw 156 engages a threaded hole in a screw mounting plate 174, preferably mounted near the rear of the base plate 150, and is rotatably received through a hole in a screw mounting plate 176 on the brake adjuster 154, which also limits any vertical movement of the brake adjuster. The adjustment screw 156 is in threaded engagement with the plate 174 so as to provide a continuous, as opposed to a discreet, adjustment capability for the brake mechanism. However, it should be understood that discreet or discontinuous adjustments can be made for the brake with other brake mechanism designs. An adjustment screw spring 178 biases the brake adjuster 154 into contact against a captivating washer 179 to position the brake adjuster in one position relative to the adjustment screw 156, so that movement of the adjustment screw also moves the brake adjuster longitudinally.

The braking mechanism can be easily used to properly adjust the force applied to the product once the shelving system is installed in the field. It may be difficult to install and properly establish at the manufacturing plant the force used to push the product forward, and such adjustment should be made in the field once product is placed on the shelf. It is easier to use a braking mechanism to account for different shelving arrangements and different product sizes and shapes than it is to accommodate those differences by changing the cord characteristics, such as cord length, thickness, and the like.

The braking mechanism also makes changing product easier. If a new product is to be displayed on the shelf, a different force may be necessary. Adjusting the counter-force created by the brake mechanism using the adjustment screw is much easier than trying to change the cord. Additionally, the adjustment screw on the brake mechanism can be used to lock the push bracket in place while the shelf is being restocked. Moreover, if the glides or slide rails become worn or dirty, the force applied by the brake mechanism can be increased by easing up on the adjustment screw so that the greater force is applied to the product through the push bracket to overcome any additional friction. Typically, a sufficiently large cord will be placed on the product advance mechanism to accommodate the various sizes and shapes of product contemplated for the shelf. If products beyond those contemplated for the shelf are to be displayed with the product advance mechanism, the cord can be replaced to increase or decrease the force that can be applied to the push bracket, or in the case of a separable product advance mechanism, the entire product advance mechanism can be replaced with another, such as one of those shown in FIGS. 12A–12D.

The braking system also takes advantage of the particular design of the product advance mechanism. The particular braking force applied can be determined for a situation where the shelf is entirely loaded with product. This is the situation where the greatest force is necessary to adequately advance product. However, the force necessary to move product decreases as product is removed. The weight of product on the product glides decreases incrementally as product is removed, thereby reducing the amount of force necessary to advance the product. However, as the push bracket advances, the stretch or extension of the elastic cord also decreases, so that the counter-force due to frictional contact between the product and the product glides decreases at the same that the force applied to the push bracket decreases.

Preferably, the push bracket is made from teflon added plastic and the slide rail from half hard stainless steel. The brake pads are also preferably made from teflon added plastic, and the brake adjuster can be formed from plastic or aluminum. The push bracket and the slide rails are preferably formed from dissimilar materials to reduce the possibility of galling between moving parts.

Figure 17:
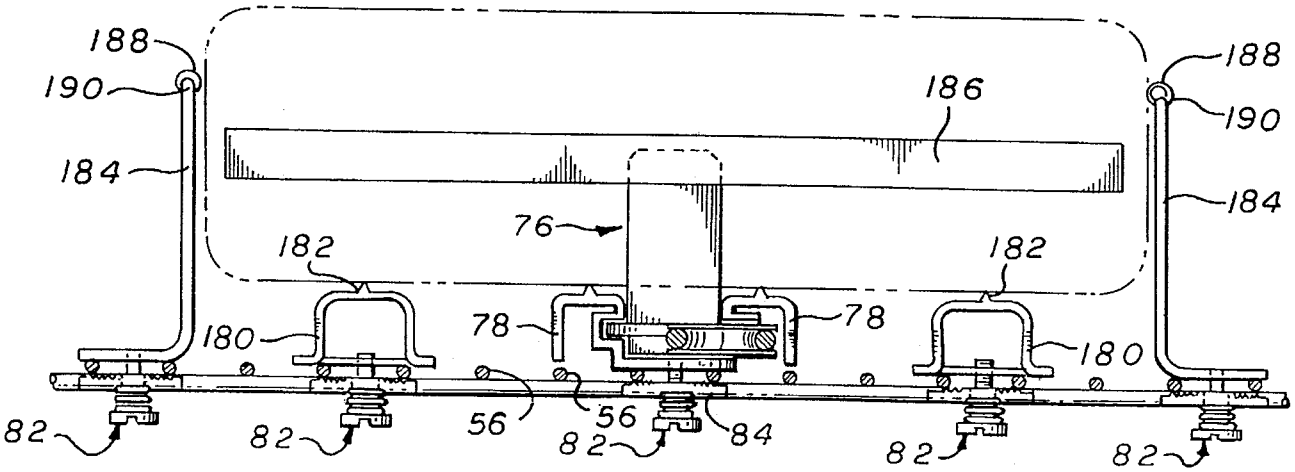
FIG. 17 is a front elevation and partial sectional view of a shelf and product advance mechanism in accordance with a further aspect of the present invention.

Product may be maintained on the shelves by any number of means. In one arrangement, product is supported from below by product glides 78 (FIG. 17). For oversized product, outriggers 180 may be provided with respective glide lines 182 for supporting the product with a minimum of frictional engagement. Product side stops 184 limit the lateral movement of the product. An oversized push bar 186 may be mounted on the push bracket 76 to provide a stable push mechanism for oversized product.

The outriggers 180 and the side stops 184 are preferably mounted to the shelf with clamps 82, which typically would have the same configuration as the clamps described with respect to FIGS. 6 and 9–11. The outriggers are preferably formed from roll formed half hard stainless steel. The product side stops may be formed from an aluminum extrusion or roll formed half hard stainless steel, and preferably include plastic glides 188 positioned over a bead 190.

The product advance mechanism works equally well with slanted shelves, but slanted shelves typically require more display case space than would horizontal shelves. The product advance mechanism or shelving incorporating integral product advance mechanisms may be easily fitted to in many rack or shelf systems. They are easily removable for cleaning or replacement. The product advance mechanism is also easily adjustable to handle product of different sizes, types and shapes. Additionally, the front-to-back depth of a shelf can be increased by using the product advance mechanism, since product will be displayed at the front of the shelf. Customers do not have to reach to the back of upper or lower shelves, since product will be displayed at the front of the shelf. Therefore, the depth of upper or lower shelves is not important for product presentation. Deeper shelves provide more stocking capability and a reduction in restocking frequency. Shelving that displays product over the entire front of the shelf also offers a very attractive display and enhances the illumination of the product displayed on the shelf. On rear-load shelving, product rotation is easily accomplished without having to adjust product already on the shelf.

In the preferred embodiment, the grooved pulley wheels preferably have an inside groove dimension which is sufficiently larger than the cord diameter in its unstretched condition to prevent any significant binding between the cord and the pulley wheel. However, there may be situations where engagement between the cord and the pulley wheel may be used to provide additional braking or control of product movement where frictional engagement between an expanded or enlarged diameter cord and the grooved pulley wheel may reduce the rate with which the cord passes around the circumference of the pulley groove.

The attachment brackets for the product advance mechanism allow the mechanism to be easily attached to wire shelves that have wires running back-to-front or side-to-side, without the use of tools. The clean out slot 98 and drain holes 111 are provided for sanitary reasons on the slide rail.

For rear load shelves or racks, a pull rod may be used to pull the push bracket back to a load position, after which the push bracket is locked using the adjustment screw. The pull rod may be a thin rod passing through a hole in the push bracket and having an enlarged end or head on the other side of the push bracket so that the enlarged end contacts the push bracket. When the shelf is to be restocked, the pull rod may be used to pull the push bracket back to the rear of the shelf and locked in position while product is placed on the product glides. A comparable push rod may be used with front load shelves, where the push rod would be almost fully removed toward the front of the shelf to be used. A hook or flange on the rod would engage the push bracket to push it back to the rear of the shelf.

For large product, two or more product advance systems can be used with independent or coupled push brackets. A single oversized push bracket may be used for light product, such as shown in FIG. 17.

The product glide 78 preferably extends longitudinally to the forward- and rearward-most points of the product advance mechanism to ensure that the product placed on the product glides are supported over the entire longitudinal depth of the shelf. As shown in FIG. 9, the pulley wheels 118 are positioned at the front of the product advance mechanism. However, the product glides may extend above and around the outer sides of the pulley wheels so that the pulley wheels are partially or fully covered from above, and so that the product is still supported at the front of the shelf. The shelf system includes a product stop (FIG. 9) having any suitable configuration in front of the shelf serving as a front stop to prevent product from moving further forward on the shelf (FIG. 9).

Although the present invention has been described in detail with reference only to the presently preferred embodiments, it will be appreciated by those of ordinary skill in the art that various modifications can be made without departing from the spirit of the invention. Accordingly, the invention is limited only by the following claims.

What is claimed is:

1. A product advance mechanism comprising:

a product contact element for contacting a product and for moving so as to push the product;

a track for supporting and guiding the product contact element as the product element moves;

a bias element for biasing the product contact element in a direction along the track; and an adjustable brake mechanism for controlling the amount of bias applied to the product contact element, the adjustable brake mechanism having a continuous predetermined range of adjustment and adapted to be set, independent of the product, within the predetermined range.

2. A product advance mechanism comprising:

a product contact element for contacting a product and for moving so as to push the product;

a track for supporting and guiding the product contact element as the product element moves;

a bias element for biasing the product contact element in a direction along the track;

an adjustable brake mechanism having a continuous range of adjustment for controlling the amount of bias applied to the product contact element; and an adjustment screw for the brake mechanism.

3. The product advance mechanism of claim 2 wherein the brake mechanism includes a converging slide element movable from a first position to a second position wherein the adjustment screw controls the movement of the slide between the first position and the second position.

4. The mechanism of claim 1 wherein the brake mechanism further includes at least one brake pad for engaging the track to control the amount of bias applied to the product contact element.

5. A product advance mechanism comprising:

a product contact element for contacting a product and for moving so as to push the product;

a track for supporting and guiding the product contact element as the product element moves;

a bias element for biasing the product contact element in a direction along the track; and an adjustable brake mechanism having a continuous range of adjustment for controlling the amount of bias applied to the product contact element, the adjustable brake mechanism including at least one brake pad for engaging the track to control the amount of bias applied to the product contact element and a support plate for supporting the brake pad and permitting the brake pad to move laterally toward and away from the track.

6. The mechanism of claim 4 wherein the track includes walls defining a groove and wherein the brake pads contact at least one of the walls of the groove to control the amount of bias applied to the product contact element.

7. The mechanism of claim 4 wherein the brake pad is a plastic brake pad.

8. The mechanism of claim 7 wherein the plastic brake pad is impregnated with teflon.

9. The mechanism of claim 1 wherein the track is a stainless steel track.

10. A product advance mechanism comprising:

a product contact element for contacting a product and for moving so as to push the product;

a track for supporting and guiding the product contact element as the product element moves, the track including two inwardly and oppositely facing track walls;

a bias element for biasing the product contact element in a direction along the track; and an adjustable brake mechanism having a continuous range of adjustment for controlling the amount of bias applied to the product contact element, the adjustable brake mechanism including a pair of oppositely facing brake pads for contacting and engaging respective walls of the track to control the amount of bias applied to the product contact element.

11. A product advance mechanism comprising:

a product contact element for contacting a product and for moving so as to push the product;

a track for supporting and guiding the product contact element as the product element moves;

a bias element for biasing the product contact element in a direction along the track;

an adjustable brake mechanism having a continuous range of adjustment for controlling the amount of bias applied to the product contact element;

a shelf for supporting the product advance mechanism and for supporting product; and an outrigger product support on the shelf for supporting a product on the shelf.

12. A product advance mechanism comprising:

a product contact element for contacting a product and for moving so as to push the product;

a track for supporting and guiding the product contact element as the product element moves;

a bias element for biasing the product contact element in a direction along the track; and an adjustable brake mechanism having a continuous range of adjustment for controlling the amount of bias applied to the product contact element, and wherein the brake mechanism includes two oppositely facing brake pads having cam surfaces, and a moveable brake adjust having contact surfaces for contacting the respective cam surfaces on the brake pads.

13. The mechanism of claim 12 wherein the brake mechanism further includes a support plate for supporting the brake pads, wherein the cam surfaces on the brake pads face at least partly in an upward direction, and wherein the brake adjust contact surfaces face at least partly downwardly.

14. The mechanism of claim 13 wherein the contact surfaces on the brake adjust element are at an angle relative to each other.

15. A product advance mechanism comprising:

a product contact element for contacting a product and for moving so as to push the product;

a track for supporting and guiding the product contact element as the product element moves;

a bias element for biasing the product contact element in a direction along the track;

an adjustable brake mechanism having a continuous range of adjustment for controlling the amount of bias applied to the product contact element;

the brake mechanism including two oppositely facing brake pads having cam surfaces, and a brake adjust having contact surfaces for contacting the respectable cam surfaces on the brake pads wherein the brake adjust is movable wherein the brake mechanism further includes a support plate for supporting the brake pads, wherein the cam surfaces on the brake pads face at least partly in an upward direction, and wherein the brake adjust contact surfaces face at least partly downwardly, and wherein the contact surfaces on the brake adjust element are at an angle relative to each other;

wherein the bias element is an elastic cord having a first end connected to the product contact element and a second end passed around a grooved pulley wheel and coupled to the track; and wherein the track includes walls defining a pair of oppositely and inwardly facing grooves, wherein the product contact element includes edges for engaging the grooves so that the product contact element is supported by the grooves of the track, and wherein the brake pads of the brake mechanism engage the walls of the grooves.

16. A mechanism for advancing a product, comprising:

a track;

a product contact element movable along the track in a predetermined direction;

a bias element operably connected to the product contact element and adapted to apply biasing force to the product contact element such that the product contact element will push the product in the predetermined direction;

a brake mechanism associated with the product contact element and adapted to apply a braking force, within a continuous range of braking forces opposing the biasing force, as the product contact element pushes the product in the predetermined direction; and a manually operable setting device associated with the brake mechanism and adapted to set the braking force at a force within the continuous range of braking forces opposing the biasing force.

17. A mechanism as claimed in claim 16, wherein the manually operable setting device comprises a spring.

18. A mechanism as claimed in claim 17, wherein the manually operable setting device further comprises an adjustment screw adapted to pre-load the spring.

19. A mechanism as claimed in claim 16, wherein the brake mechanism comprises at least one brake pad adapted to engage the track.

* * * * *